US006632304B2

(12) United States Patent
Oyama et al.

(10) Patent No.: US 6,632,304 B2
(45) Date of Patent: Oct. 14, 2003

(54) TITANIUM ALLOY AND PRODUCTION THEREOF

(75) Inventors: Hideto Oyama, Takasago (JP); Shinya Ishigai, Takasago (JP); Masamitsu Fujii, Chiyoda-ku (JP); Tadasu Abumiya, Chiyoda-ku (JP)

(73) Assignee: Kabushiki Kaisha Kobe Seiko Sho, Kobe (JP)

( * ) Notice: Subject to any disclaimer, the term of this patent is extended or adjusted under 35 U.S.C. 154(b) by 0 days.

(21) Appl. No.: 09/897,964

(22) Filed: Jul. 5, 2001

(65) Prior Publication Data

US 2001/0050117 A1 Dec. 13, 2001

Related U.S. Application Data

(63) Continuation of application No. 09/321,596, filed on May 28, 1999, now abandoned.

(30) Foreign Application Priority Data

May 28, 1998 (JP) ..... 10-147963
May 28, 1998 (JP) ..... 10-147965
Jun. 4, 1998 (JP) ..... 10-155630

(51) Int. Cl.[7] ..... C22D 1/18
(52) U.S. Cl. ..... 148/671

(58) Field of Search ..... 48/671, 670

(56) References Cited

U.S. PATENT DOCUMENTS 4,053,330 A * 10/1977 Henricks et al. ..... 148/671
5,264,055 A 11/1993 Champin et al.
5,885,375 A * 3/1999 Takemura et al. ..... 148/671
6,284,071 B1 * 9/2001 Suzuki et al. ..... 148/671

* cited by examiner

*Primary Examiner*—Roy King
*Assistant Examiner*—Harry D. Wilkins, III
(74) *Attorney, Agent, or Firm*—Oblon, Spivak, McClelland, Maier & Neustadt, P.C.

(57) ABSTRACT

A near-β or β titanium alloy having high strength, high ductility, and high toughness which is capable of coil rolling at a high temperature and recoiling for high productivity, and a process for producing said titanium alloy. The titanium alloy contains not more than 1.0% (excluding 0%) of Si alone or in combination with not more than 10% of Sn. The process comprises heating a β alloy or near-β alloy containing not more than 1.0% (excluding 0%) of Si alone or in combination with not more than 10% of Sn and subjecting said alloy to plastic deformation while keeping silicides solved in it at a temperature above the β-transus, so that silicides precipitate in the form of fine particles, with recrystallization suppressed. The resulting titanium alloy is good in workability and has high strength after aging treatment.

9 Claims, 13 Drawing Sheets

TITANIUM ALLOY AND PRODUCTION THEREOF

This application is a Continuation of application Ser. No. 09/321,596 Filed on May 28, 1999, now abandoned.

BACKGROUND OF THE INVENTION

1. Field of the Invention

The present invention relates to a titanium alloy and a process for producing the same. The titanium alloy has high strength and good workability and hence is suitable for such applications as aircraft engine and golf club face which need good mechanical properties including high strength, ductility, and toughness.

2. Description of the Related Art

Among high-strength titanium alloys are so-called near-β alloys typified by Ti-10V-2Fe-3Al and Ti-5Al-2Sn-2Zr-4Mo-4Cr. These titanium alloys undergo β-process so that they have good balanced strength and toughness. This process consists of heating a titanium alloy above the β-transus and then subjecting it to plastic deformation before the α phase precipitates, so that a large number of precipitation sites are introduced into β grains. This process prevents the α phase from preferentially precipitating at the grain boundary, which would otherwise precipitate to degrade strength after cooling or aging, and also permits the acicular microstructure to develop all over in the subsequent heat treatment. This process is designed basically to make the β phase undergo work hardening by plastic deformation, while suppressing the precipitation of the α phase during plastic deformation, and then cause the α phase to precipitate in the uncrystallized β matrix at an adequate temperature below the β-transus.

On the other hand, if an ingot of titanium alloy is to be forged, it has to be heated again because it is usually cooled. Unfortunately, reheating is not allowed after the β process because it destroys the previous sub-structure. Therefore, the titanium alloy has to be formed into a shape by plastic deformation which can be finished in a short time by single heating. This poses a problem with low yields.

Among other high-strength titanium alloys are β alloys typified by Ti-15Mo-5Zr-3Al and Ti-15V-3Cr-3Sn-3Al. These titanium alloys are superior in cold-workability and are capable of precipitation hardening due to precipitation of the α phase from the metastable β phase by aging. Since these titanium alloys enable cold-rolling before aging, strips can be produced most efficiently by sequential steps of hot rolling (as in the case of commercially pure titanium strips), coiling, optional solution treatment, and cold rolling and annealing (at a temperature close to that of solution treatment), by making use of the feature of β titanium alloys.

However, β alloys such as Ti-15Mo-5Zr-3Al highly liable to age hardening experience additional age hardening due to remaining heat after hot rolling and coiling to such an extent that the coiled strips cannot be recoiled. A conceivable way to avoid this trouble is by batch-annealing in the coiled state. This is not desirable, however. From the standpoint of strength after aging treatment, it is desirable to perform cold working further while keeping the work-hardened conditions caused by hot-rolling, or preferably without annealing, so that the fine uniform α phase is precipitated. Annealing above the β-transus causes recrystallization and grows grains, and annealing below the β-transus causes the α phase to precipitate. Thus, annealing greatly impairs the subsequent cold workability and the strength after aging treatment.

To avoid this trouble, it is necessary to employ the so-called sheet rolling method for Ti-15Mo-5Zr-3Al which is in general use today. (Sheet rolling is intermittent operation that hinders productivity.)

Because of their high strength, near-β alloys and β alloys are used for aircraft engine parts and golf club face which need high strength. These titanium alloys, however, pose a problem when they undergo age hardening to increase strength. That is, if they are hot-rolled at a higher temperature, their β microstructure becomes so coarse as to bring about extreme embrittlement. Therefore, they have to be hot-rolled at a lower temperature. However, this is difficult to practice with the existing facilities on account of the limited rolling load. The present practical way of making sheets from high-strength near-β alloys or β alloys is the so-called sheet rolling which is capable of rolling at a low temperature without requiring recoiling as mentioned above. This process is extremely poor in productivity.

The above-mentioned problem with near-β alloys and β alloys stems from the fact that it is desirable for the alloy to have a high degree of supersaturation and to precipitate the fine uniform α phase easily for its high strength, with the matrix kept in the work-hardened state resulting from hot working, whereas the easily precipitated α phase produces an adverse effect in the course of working.

OBJECT AND SUMMARY OF THE INVENTION

The present invention was made in view of the foregoing. An object of the present invention is to provide a titanium alloy, particularly near-β alloy and β alloy, having high strength, high ductility, and high toughness, suitable for use as aircraft engine parts and golf club face, while permitting coil-rolling and coiling at a high temperature for high productivity. Another object of the present invention is to provide a process for producing efficiently and certainly such a titanium alloy having remarkable functional properties.

The first aspect of the present invention resides in a process for producing a titanium alloy which comprises heating a β titanium alloy or near-β titanium alloy containing not more than 1.0% (excluding 0%) of Si and subjecting said alloy to plastic deformation while keeping silicides solved in it at a temperature above the β-transus, so that silicides precipitate in the form of fine particles, with recrystallization suppressed. This process may be used to produce a titanium alloy which has good workability and exhibits high strength after aging treatment. ("%" means "mass %" throughout this specification.)

The second aspect of the present invention resides in a process for producing a high-strength titanium alloy which comprises performing hot working on a β titanium alloy or near-β titanium alloy containing not more than 1.0% (excluding 0%) of Si such that the hot working finishes at a temperature lower than the solvus of silicides and subsequently performing aging treatment (including annealing) or both solution treatment and aging treatment (including annealing) in the two-phase region at a temperature below the β-transus, without heating above said solvus, thereby causing the acicular α phase to precipitate almost all over the β phase matrix.

In this process, said hot working may be followed by heating to a temperature above the β-transus and below the solvus of silicides before the aging treatment (including annealing) or both the solution treatment and aging treatment (including annealing). Heating in this way causes the α phase to precipitate in a fine uniform acicular form in the β phase which has not yet recrystallized. Thus, the resulting titanium alloy has high strength due to precipitation hardening.

The above-mentioned process may be applied to the production of a titanium alloy from a titanium alloy ingot. In this case, hot working is carried out such that it finishes at a temperature below the solvus of silicides and hot working is followed by heat treatment at a temperature above the precipitation temperature of silicides. The heat treatment in this manner causes fine precipitates of silicides to form a solid solution once and the β phase recrystallizes to become fine crystal grains, so that the subsequent precipitation of the fine suicides and the acicular α phase add to the strength and toughness of the titanium alloy after aging treatment.

The titanium alloy pertaining to the present invention is a β alloy or near-β alloy containing not more than 1.0% (excluding 0%) of Si which is characterized in that said Si is present in the form of uniformly dispersed precipitant of silicides having a particle size smaller than 1 μm (excluding 0 μm). According to a preferred embodiment, the alloy contains the acicular a phase which precipitates substantially throughout the β phase matrix, so that the alloy exhibits remarkable strength, ductility, and toughness.

The titanium alloy specified above may contain not more than 10% of Sn, so that its age hardening is delayed. The resulting alloy is exempt from age hardening due to remaining heat after coil rolling and troubles with recoiling. This enables continuous rolling (coil rolling) and greatly improves the post-rolling steps.

The present invention produces its full effect when the alloy contains β-stabilizing elements as much as specified by the formula below.

$$0.60 \leqq \%\ Mo/10 + \%\ V/15 + \%\ Fe/4 + \%\ Cr/8 + \%\ Mn/6 + \%\ Co/6 + \%\ Ni/8 + \%\ W/25 + \%\ Nb/36 + \%\ Ta/50 \leqq 2.0$$

A preferred titanium alloy of the present invention is a near-β titanium alloy containing Mo 13–17%, Zr 3–7%, and Al 1.5–4.5% (typically a Ti-15Mo-5Zr-3Al-3Sn alloy).

Another preferred titanium alloy of the present invention is a near-β titanium alloy containing Al 3–7%, Mo 2–6%, Cr 2–6%, and Zr 1–6% (typically a Ti-5Al-2Sn-2Zr-4Mo-4Cr alloy).

DESCRIPTION OF THE PREFERRED EMBODIMENT

Figure 1A:
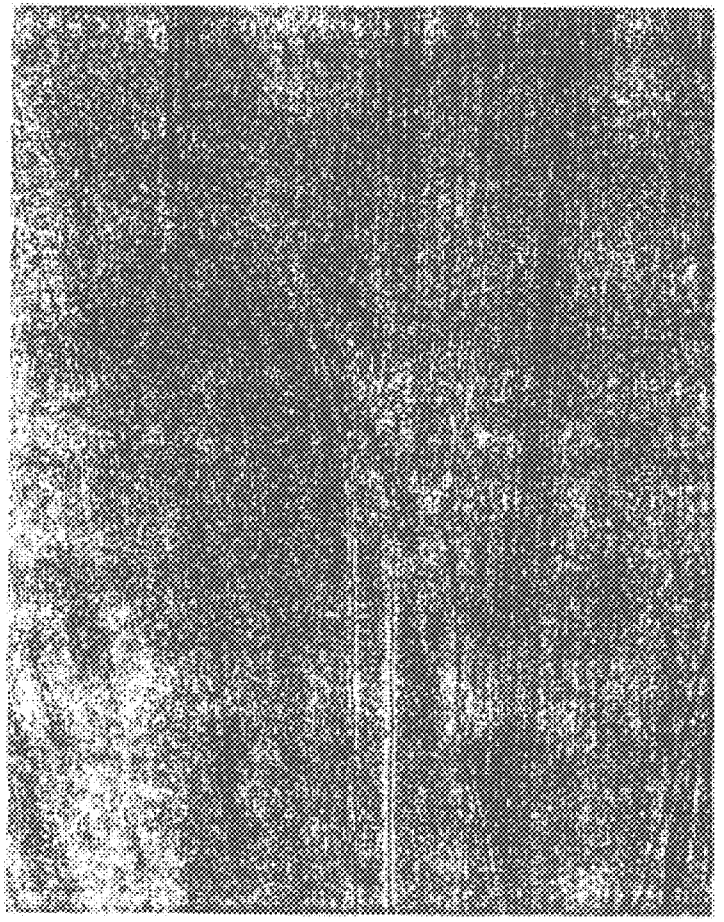
FIGS. 1(A), 1(B), and 1(C) are optical micrographs showing the microstructure of the alloy (1) as hot-rolled, after heat-treatment at 1050° C. for 30 minutes, and after heat treatment at 1200° C. for 30 minutes, respectively.

The first process in the present invention is the result of studies carried out to address the problems involved in the prior art technology as mentioned above. It is based on the finding that a near-β alloy or β alloy incorporated with Si in an adequate amount causes suicides to precipitate at a high temperature above the β-transus and these silicides dissolve upon heating at a higher temperature.

In other words, when a near-β alloy or β alloy incorporated with Si in an adequate amount is heated, a second phase (presumably of silicides) precipitates at about 1050° C. which is above the β-transus independently of the precipitation of the α phase. Moreover, this second phase is unique in that it dissolves at a high temperature of about 1200° C. which is easily attained industrially.

This phenomenon is taken full advantage of by the present invention. In other words, the near-β alloy or β alloy contains Si in such an amount that silicides dissolve and disappear at a high temperature of about 1200° C. and precipitates in the form of fine particles at a temperature of about 1050° C. When this Si-containing titanium alloy is heated to about 1200° C. or above, so that silicides dissolve completely, and then undergoes plastic deformation, the suicides precipitate in the form of fine particles during plastic deformation, thereby suppressing recrystallization in the subsequent reheating. This enables repeated heating and rolling.

In addition, if the titanium alloy contains Sn as well as Si, then the precipitation of the α phase decreases in kinetics to such an extent that age hardening by remaining heat (which exists in the period from the winding of hot-rolled coil to the cooling to room temperature), without producing adverse effect on the degree of supersaturation of suicides or without impairing the ability of precipitation hardening of the α phase.

These phenomena are utilized in the present invention in such a way that the titanium alloy is heated to a temperature at which silicides disappear and then undergoes plastic deformation in the state of complete solid solution, so that silicides uniformly and finely disperse in the matrix at about 1050° C. in the course of cooling. The precipitation of silicides promotes work hardening (or suppresses recovery and recrystallization) but subsequently lowers the kinetics of precipitation in the region of the α phase precipitation at a temperature lower than the β-transus. This suppresses the precipitation of the α phase by remaining heat.

For a near-β alloy or β alloy to have an overall acicular microstructure for high strength, ductility, and toughness, it is essential that the alloy acquire the unrecrystallized β phase microstructure before the solution treatment or aging treatment. The second process of the present invention is designed to produce efficiently and certainly a titanium alloy having an overall acicular microstructure which is superior in strength, ductility, and toughness.

This process is characterized in that working finishes at about 1050° C. at which silicides precipitate and, in any subsequent step, the alloy temperature does not reach about 1200° C. at which silicides disappear. The result of working in this way is that the silicides which have precipitated first remain undissolved even when the alloy is heated above the β-transus, and the presence of suicides maintain the unrecrystallized state which has existed during hot working. The alloy can undergo heat treatment and hot working repeatedly so long as it is at a temperature lower than the solvus at which silicides disappear. This leads to easy shaping and greatly improves yields in fabrication.

If the alloy temperature is controlled such that working finishes at a temperature above the solvus of silicides, the recrystallization of the β phase proceeds in the subsequent cooling step, causing the grain boundary α phase to occur after the aging treatment or after the solution treatment and aging treatment, which is necessary to give high strength eventually. This leads to reduced ductility. Therefore, it is essential that working finishes at a temperature below the solvus of silicides. Even though this requirement is met, the alloy should not be reheated above the solvus in the subsequent steps; otherwise, the β phase recrystallizes and the grain boundary α phase occurs, which leads to reduced ductility.

If all the steps of hot working are performed at a temperature above the β-transus, there arise no problems because the equiaxial α phase detrimental to toughness does not exist. In actual working, however, temperature decreases during working even though heating for hot working exceeds the β-transus. Therefore, actual working unavoidably takes place substantially in the α+β region in most cases. This leads to reduced toughness and hence should be avoided. It is impossible to prevent the α phase from becoming equiaxial by incorporation with Si in an adequate amount.

The microstructure after the final heat treatment (aging treatment or both solution treatment and aging treatment) depends greatly on how the unrecrystallized β phase is cooled from the β temperature region. If the alloy undergoes heat treatment as such after hot working, the temperature at which working finishes varies from one place to another in the work (depending on the shape and size of the work). This results in an uneven microstructure and a variation among products. To avoid this, it is necessary to have the stock preheated uniformly. In a preferred embodiment hot working is carried out such that it finishes at a temperature below the solvus of silicides and subsequently the work is heated at a temperature of silicide precipitation which is above the β-transus and below the solvus of suicides. The advantage of this process is that the recrystallization of the β phase is suppressed due to the presence of suicides. Hence, the a phase which has precipitated during working entirely forms the solid solution while keeping the unrecrystallized state. Upon adequate cooling from this state, there is obtained a uniform stock (prior to heat treatment) free of the equiaxial α phase.

An extremely effective way to obtain formed products having a fine microstructure is one in which hot working is carried out on a titanium ingot such that it finishes at a temperature below the solvus of silicides and hot working is followed by heat treatment at a temperature above the precipitation temperature of silicides. In a system in which silicides exist, the recrystallization of the βphase is suppressed. The β grains formed in the titanium ingot are as large as several centimeters. These coarse structure units (or macrostructure units) are flattened to some extent during hot working. However, this structure is brought to the formed product unless the β grains are recrystallized. The result is variation in characteristic properties.

In order to make the macrostructure fine, it is necessary to introduce plastic strain for the recrystallization of the β phase in any one step of the process for producing the formed product from an ingot. This recrystallization is accomplished by performing hot working such that hot working finishes at a temperature lower than the solvus of suicides and, in any subsequent step, the work is heated above a temperature at which silicides disappear or dissolve, (because, in a system in which silicides exist, the recrystallization of the β phase is suppressed). This heating step may be accomplished by simply heating the billet. Alternatively, it is also possible to establish a temperature for hot working above the precipitation temperature of silicides so as to reduce the frequency of heating which adds to production cost. In sum, heating may be accomplished in any manner so long as the temperature exceeds the solvus of silicides.

For the recrystallization of the β phase, it is necessary to impart sufficient strains to the β phase in such a way that hot working finishes at a temperature below the solvus of silicides or the region in which suicides precipitate. At a temperature above the solvus, the β phase does not recrystallize or merely gives rise to coarse grains even though it recrystallizes. If the heating temperature is in the region of silicide precipitation (or below the solvus), recrystallization is hampered by silicides. Thus, it is essential to heat to a temperature at which suicides disappear.

As mentioned above, reheating is not allowed in the β process of near-β alloys, and solution treatment cannot be performed for β alloys because solution treatment after hot rolling brings about recrystallization. According to the present invention, recrystallization is suppressed due to the silicides which have precipitated in the finely dispersed state, as mentioned above. Therefore, it is possible to maintain the unrecrystallized microstructure even though reheating is performed, so long as the reheating temperature is low enough for silicides to remain. The effect of silicide precipitation is markedly produced when Si is added alone or together with Sn in an adequate amount. A near-β alloy or β alloy which is incorporated with an adequate amount of Si or Si plus Sn and which has a microstructure with silicides finely and uniformly dispersed exhibits outstanding strength, ductility, and toughness. The alloy has further improved properties if it has such a structure that the acicular α phase is dispersed substantially all over the β matrix.

The term "fine precipitation of silicides" means precipitation whose particle size is smaller than 1 μm (or of submicron order). If the particle size is larger than 1 μm, the above-mentioned effect of the present invention is not fully produced.

It is desirable that silicides disperse such that the distance between adjacent particles of the same kind is 1 to 10 μm. This enhances the effect of the present invention. With a greater distance, the effect is insufficient; with a smaller distance, there is a possibility of embrittlement due to precipitation hardening.

The term "such a microstructure that the acicular α phase is dispersed substantially all over the β matrix" means that the α phase in the dispersed state is mostly the acicular α phase, with an extremely small portion existing in the form of grain boundary α phase. Precipitation seen in the photographs of structure attached hereto falls under the category of the overall acicular state. Incidentally, it is substantially impossible that the acicular α phase is formed in the dispersed state, with the grain boundary α phase being absolutely absent. Even though part of the acicular α phase is present in the form of grain boundary α phase, it is possible to achieve the object of the present invention (high strength, high ductility, and high toughness) so long as most of the acicular α phase is present in the dispersed form. The acicular α phase should have a thickness of 2–5 μm (after initial precipitation) and 0.5–2 μm (after aging precipitation), so that the present invention produces its full effect.

As mentioned above, the present invention is based on the finding that when the near-β alloy or β alloy is incorporated with Si or Si plus Sn, the second phase of suicides precipitates in the fine dispersed form, thereby preventing the precipitates from recrystallization. Therefore, the composition of the titanium alloy is not specifically restricted in the present invention. However, it is desirable that the near-β alloy or β alloy contains β-stabilizing elements as much as specified by the formula below. (This formula is based on an empirical β stabilizing index.)

$$0.60 \leqq \%\ Mo/10 + \%\ V/15 + \%\ Fe/4 + \%\ Cr/8 + \%\ Mn/6 + \%\ Co/6 + \%\ Ni/8 + \%\ W/25 + \%\ Nb/36 + \%\ Ta/50 \leqq 2.0$$

If the total amount of β-stabilizing elements is less than 0.60, the resulting alloy is outside the category of near-β alloy. On the other hand, if it exceeds 2.0, the resulting alloy is a β alloy but is outside the category of the β alloy with a high degree of supersaturated intended in the present invention. Therefore, such an alloy does not exhibit the features of the present invention.

The content of Si broadly ranges depending on the kind and amount of other elements in the alloy. The lower limit is defined as an amount enough for the second phase to precipitate at a temperature above the β-transus. A standard lower limit is 0.03%, preferably 0.05%. This is a minimum amount necessary for the second phase to precipitate in the fine dispersed state so as to produce the above-mentioned effect. On the other hand, the upper limit is 1.0%, which has been established from the standpoint of preventing the excessive precipitation of the second phase and the embrittlement due to precipitation hardening.

The content of Sn also broadly ranges depending on the kind and amount of other elements in the alloy and also on the extent to which the kinetics of precipitation of the α phase is reduced. The lower limit is usually 0.3%, preferably 0.5%. An amount more than 1.0% will be sufficient to reduce the kinetics of precipitation of the α phase as desired. The upper limit of Sn content should be ordinarily 10%, preferably 6%, and more desirably 5%, so that the cold workability of the alloy is not hampered.

A titanium alloy incorporated with Si or Si and Sn in an adequate amount constitutes the feature of the present invention. It may contain other elements so long as it takes on the near-β form or β form. Such elements are β stabilizing elements (e.g., Mo, V, Fe, Cr, Mn, Co, Ni, W, Nb, and Ta), α stabilizing elements (e.g., Al and C), and neutral elements (e.g., Zr).

The present invention will manifest its most remarkable feature mentioned above when the titanium alloy has the following composition A or B.

Alloy composition A: with alloying elements (in mass %) other than Ti, Si, and Sn.

Mo: 13–17%

Zr: 3–7%

Al: 1.5–4.5%

The preferred content of each alloying element has been established as above for the reasons given below.

Mo: 13–17%

Mo enhances the effect of age hardening. Its content should be more than 13%, preferably more than 14%, so that it produces its full effect. With an excess amount, it produces the β stabilizing effect extremely, resulting in reduced age hardening and reduced strength after aging treatment. The content of Mo should be less than 17%, preferably less than 16%.

Zr: 3–7%

Zr dissolves in both the α phase and β phase so as to strengthen them. Its content should be more than 3%, preferably more than 4%, so that it produces its full effect. With an excess amount, it has an adverse effect on hotworking and cold working. Its maximum content should be 7%, preferably 6%.

Al: 1.5–4.5%

Al strengthens the α phase resulting from age precipitation. Its content should be more than 1.5%, preferably more than 2.5%, so that it produces its full effect. With an excess amount, it has an adverse effect on hot working and cold working. Thus, it should be less than 4.5%, preferably less than 4.0%.

A titanium alloy that meets the requirement of the alloy composition A is exemplified by a Ti-15Mo-5Zr-3Al alloy. This alloy may be incorporated with Si or Si and Sn to give the high-strength titanium alloy of the present invention.

Alloy composition B: with alloying elements (in mass %) other than Ti, Si, and Sn.

Al: 3–7%

Mo: 2–6%

Cr: 2–6%

Zr: 1–6%

The preferred content of each alloying element has been established as above for the reasons given below.

Al: 3–7%

Al strengthens the α phase resulting from age precipitation. Its content should be more than 3%, preferably more than 4%, so that it produces it full effect. With an excess amount, it has an adverse effect on hot working and cold working. Thus, it should be less than 7%, preferably less than 6%.

Mo: 2–6%

Mo enhances the effect of age hardening. Its content should be more than 2%, preferably more than 2.5%, so that it produces its full effect. With an excess amount, it produces the β stabilizing effect extremely, resulting in reduced age hardening and reduced strength after aging treatment. The content of Mo should be less than 6%, preferably less than 5%.

Cr: 2–6%

Cr also enhances the effect of age hardening like Mo. Its content should be more than 2%, preferably more than 2.5%, so that it produces its full effect. With an excess amount, it produces the β stabilizing effect extremely, resulting in reduced age hardening and reduced strength after aging treatment. The content of Cr should be less than 6%, preferably less than 5%.

Zr: 1–6%

Zr dissolves in both the α phase and β phase so as to strengthen them. Its content should be more than 1%, preferably more than 2%, so that it produces its full effect. With an excess amount, it has an adverse effect on hot working and cold working. Its maximum content should be 6%, preferably 5%.

A titanium alloy that meets the requirement of the alloy composition B is exemplified by a Ti-5A1-2Zr-4Mo-4Cr alloy. This alloy may be incorporated with Si or Si and Sn to give the high-strength titanium alloy of the present invention.

The balance of the above-mentioned alloy compositions A and B is substantially titanium although it may contain other elements and unavoidable impurities in small amounts not harmful to the feature of the present invention.

The titanium alloy of the above-mentioned composition A permits recoiling owing to slow aging without adverse effect on strength and ductility after aging treatment, while contributing to improved productivity by coil rolling. In addition, it is comparable to its base alloy in strength and ductility if it undergoes aging treatment for an adequate time. Therefore, it will find use as the golf club face which, owing to its high strength and high coefficient of rebound, will drive a ball over a longer distance.

The titanium alloy of the above-mentioned composition B permits reheating in the forging step without adverse effect on strength, ductility, and toughness after aging treatment, thereby greatly improving yields. It will find use as jet engine fans and compressor disks which need uniform properties and high reliability. It expands the application areas of near-β alloys.

The invention will be described in more detail with reference to the following examples, which are not intended to restrict the scope thereof. Obviously, many modifications and variations of the present invention are possible in the light of the teachings given above and later, and they are within the scope of the present invention.

EXAMPLE 1

Five kinds of titanium alloys specified below were prepared.

Ti-15Mo-5Zr-3Al, used as such for comparison
Ti-15Mo-5Zr-3Al plus Sn (3%), for comparison
Ti-15Mo-5Zr-3Al plus Si (0.3%), for comparison
Ti-15Mo-5Zr-3Al plus Si (0.5%)
Ti-15Mo-5Zr-3Al plus Sn (3%) and Si (0.3%)

(The first alloy was chosen as a conventional one which does not unable recoiling due to age hardening by remaining heat after hot rolling.) Each alloy underwent button melting and casting and the resulting ingot was heated to 1200° C. and hot-rolled with a rolling degree of 50%. The hot-rolled sheet was kept at 1050° C. for 10 minutes to promote precipitation of the second phase. It was further hot-rolled to give a hot-rolled sheet with a total rolling degree of 75%.

After heat-treatment at 1050° C. (which is above the β transus), each hot-rolled sheet was examined for precipitation of the second phase and recrystallization by optical microscopy. It was also examined for difference in hardness before and after hot rolling and for change in hardness after aging at 500° C. for 0.5 to 8 hours so as to see how work hardening is promoted and how the kinetics of the α phase precipitation is decreased. Finally, after age treatment at 500° C. for 8 hours, each hot-rolled sheet underwent tensile test to measure strength and elongation. The results of measurement are shown in Table 1. The alloys have the structure as shown by optical micrographs (×100) in FIGS. 1 to 5.

FIG. 1 Ti-15Mo-5Zr-3Al-0.5Si alloy

FIG. 1(A) As hot-rolled, with silicides precipitated

Figure 1B:
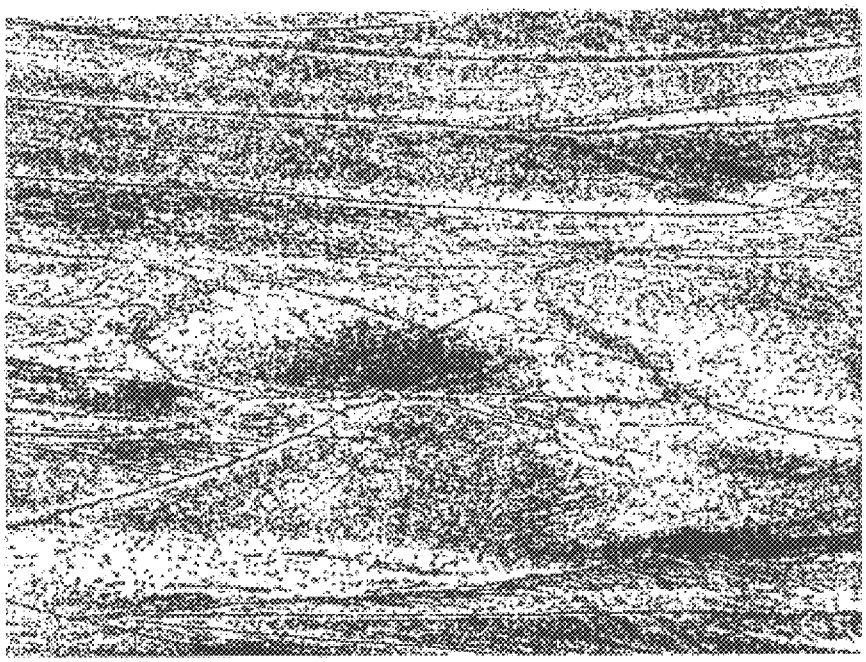

FIG. 1(B) Heat-treated at 1050° C. for 30 minutes, with recrystallization suppressed (and hence the unrecrystallized state kept) due to remarkable silicide precipitation.

Figure 1C:
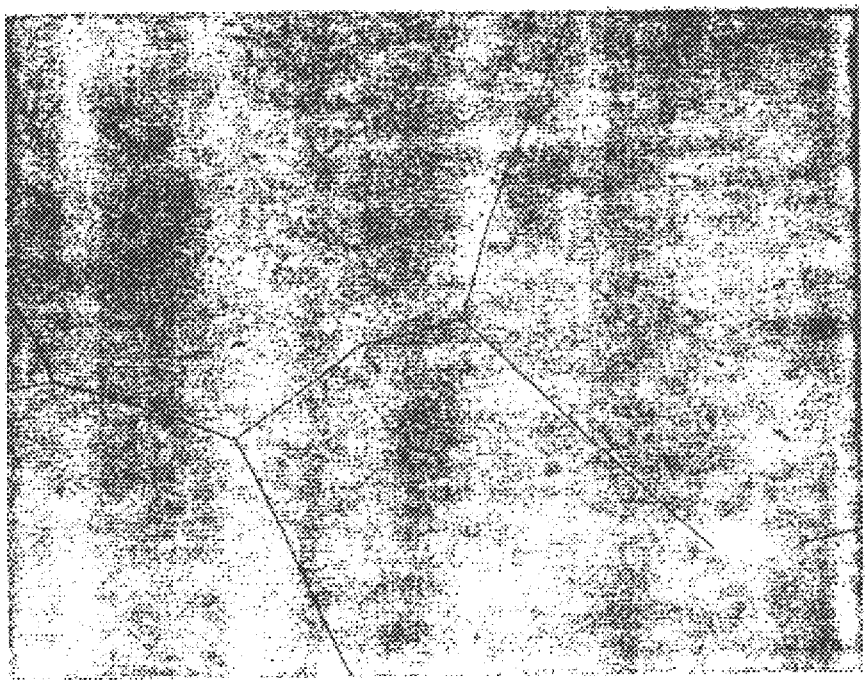

FIG. 1(C) Heat-treated at 1200° C. for 30 minutes, with silicides disappeared (dissolved) and hence recrystallization occurred.

FIG. 2 Ti-15Mo-5Zr-3Al-3Sn-0.3Si alloy

Figure 2A:
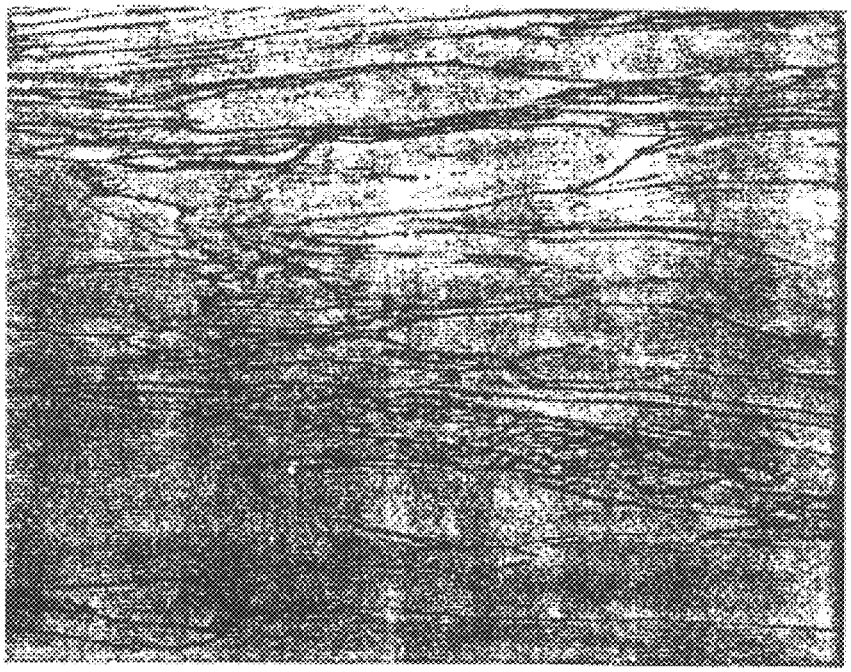
FIGS. 2(A), 2(B), and 2(C) are optical micrographs showing the microstructure of the alloy (2) as hot-rolled, after heat-treatment at 1050° C. for 30 minutes, and after heat treatment at 1200° C. for 30 minutes, respectively.

FIG. 2(A) As hot-rolled, with silicides precipitated

Figure 2B:
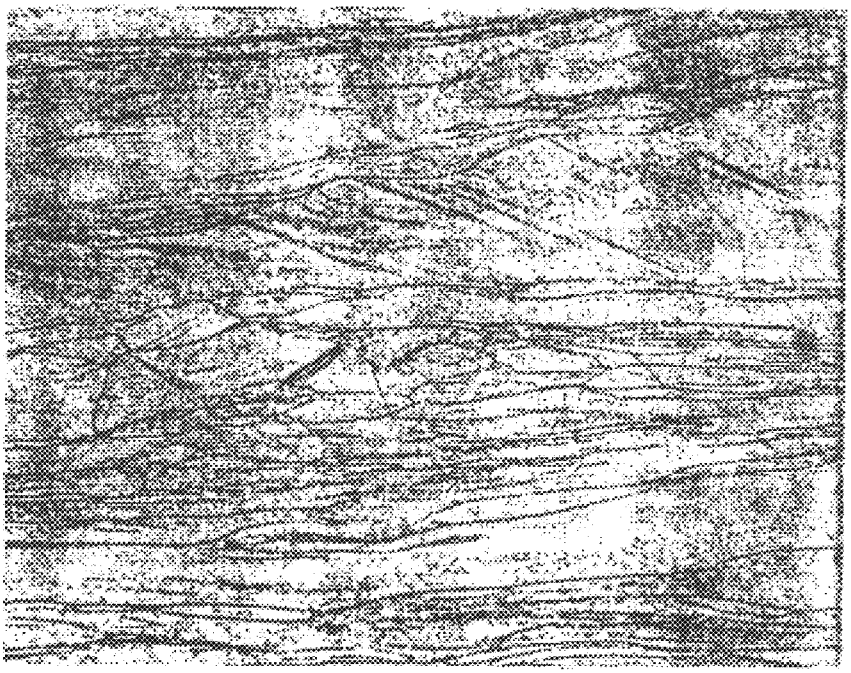

FIG. 2(B) Heat treated at 1050° C. for 30 minutes, with recrystallization suppressed (and hence the unrecrystallized state kept) due to remarkable silicide precipitation.

Figure 2C:
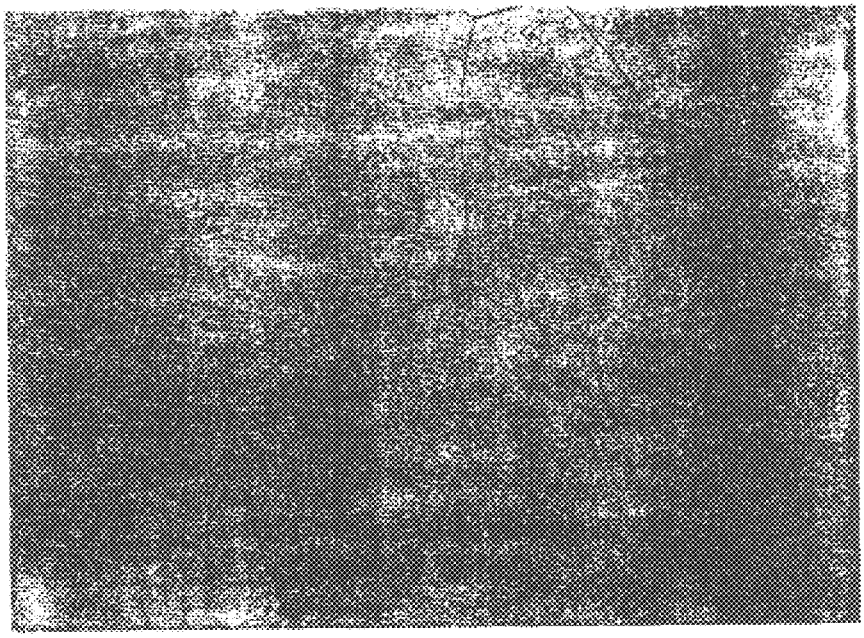

FIG. 2(C) Heat-treated at 1200° C. for 30 minutes, with suicides disappeared (dissolved) and hence recrystallization occurred.

FIG. 3 Ti-15Mo-5Zr-3Al alloy

Figure 3A:
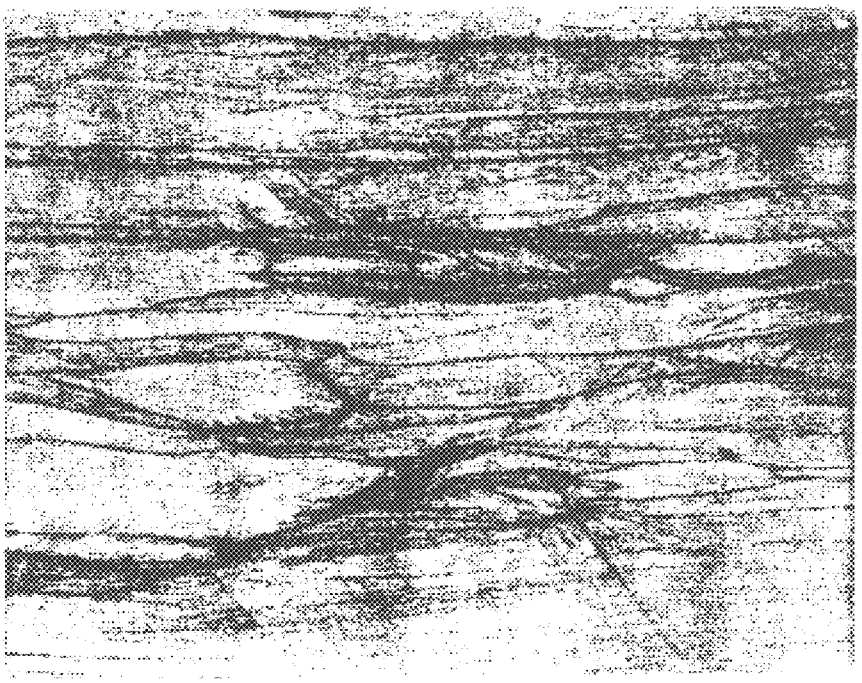
FIGS. 3(A), 3(B), and 3(C) are optical micrographs showing the microstructure of the alloy (3) as hot-rolled, after heat-treatment at 1050° C. for 30 minutes, and after heat treatment at 1200° C. for 30 minutes, respectively.

FIG. 3(A) As hot-rolled, with work hardening

Figure 3B:
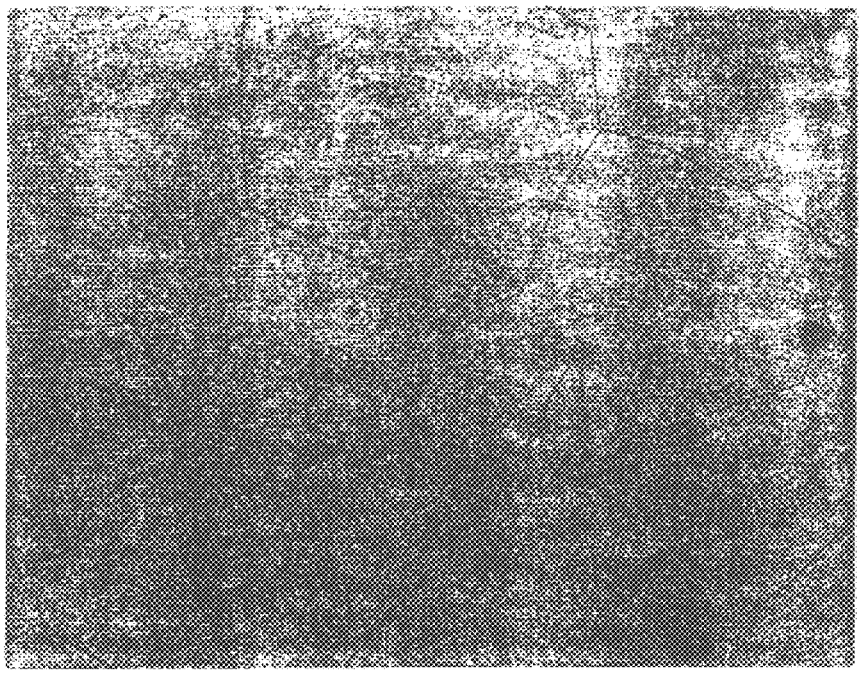

FIG. 3(B) Heat-treated at 1050° C. for 30 minutes, with recrystallization in the absence of precipitation of silicides to suppress recrystallization.

Figure 3C:
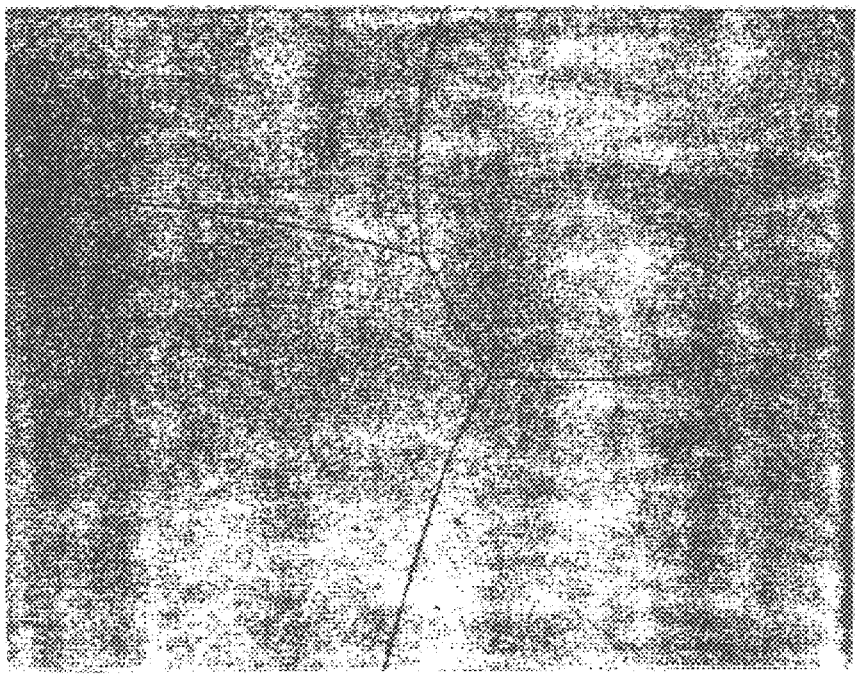

FIG. 3(C) Heat-treated at 1200° C. for 30 minutes, with coarse grains grown due to recrystallization.

FIG. 4 Ti-15Mo-5Zr-3Al-0.3Si alloy

Figure 4A:
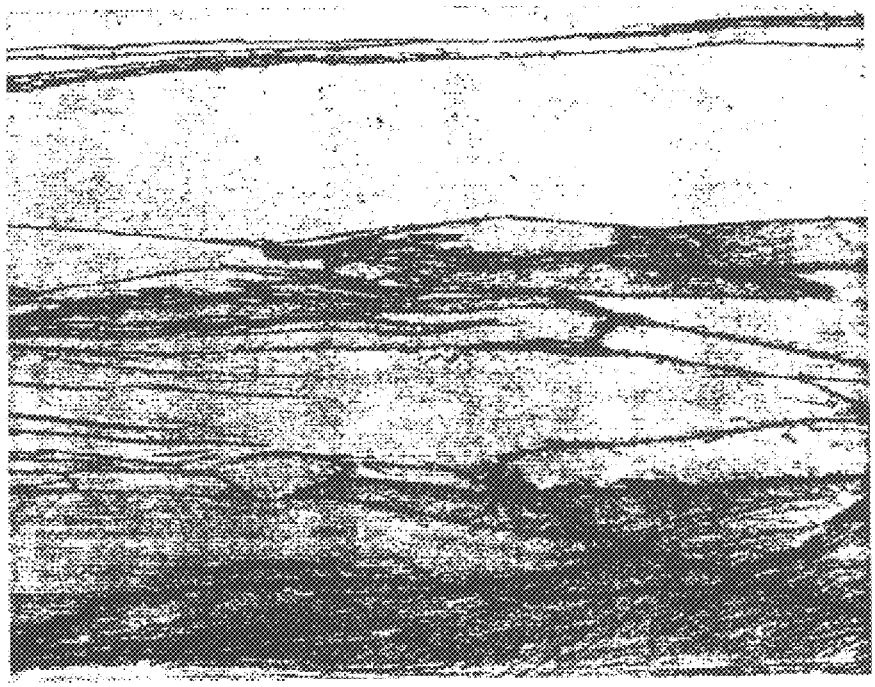
FIGS. 4(A), 4(B), and 4(C) are optical micrographs showing the microstructure of the comparative alloy (4) as hot-rolled, after heat-treatment at 1050° C. for 30 minutes, and after heat treatment at 1200° C. for 30 minutes, respectively.

FIG. 4(A) As hot-rolled, with work hardening

Figure 4B:
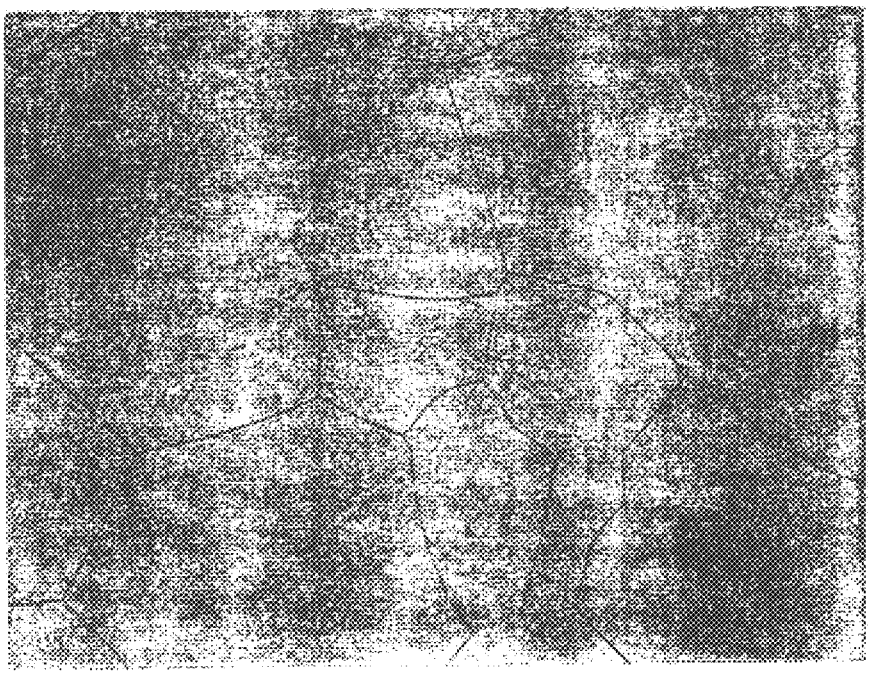

FIG. 4(B) Heat-treated at 1050° C. for 30 minutes, with recrystallization due to insufficient precipitation of silicides to suppress recrystallization.

Figure 4C:
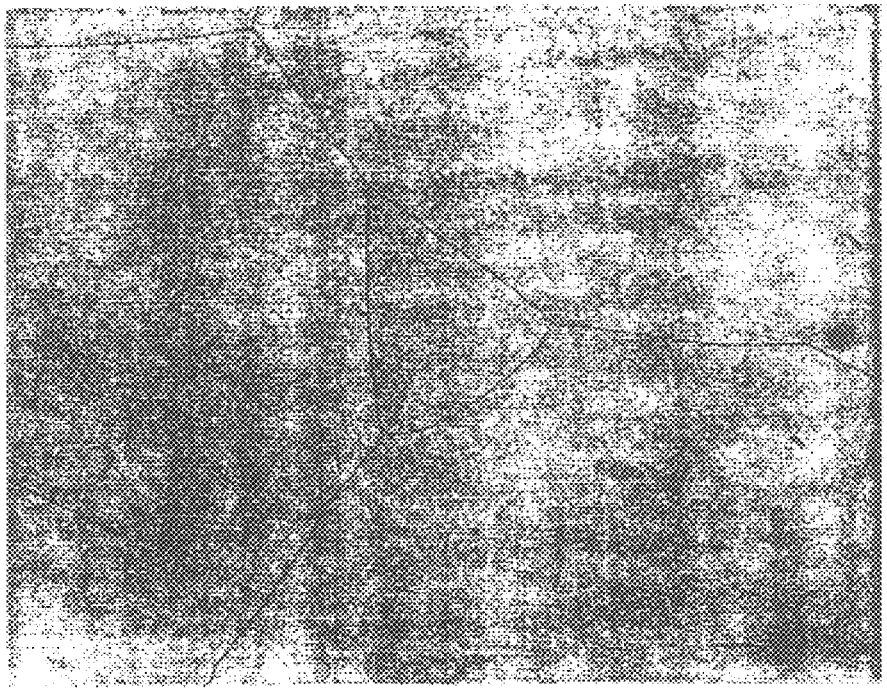

FIG. 4(C) Heat-treated at 1200° C. for 30 minutes, with coarse grains grown due to recrystallization.

FIG. 5 Ti-15Mo-5Zr-3Al-3Sn alloy

Figure 5A:
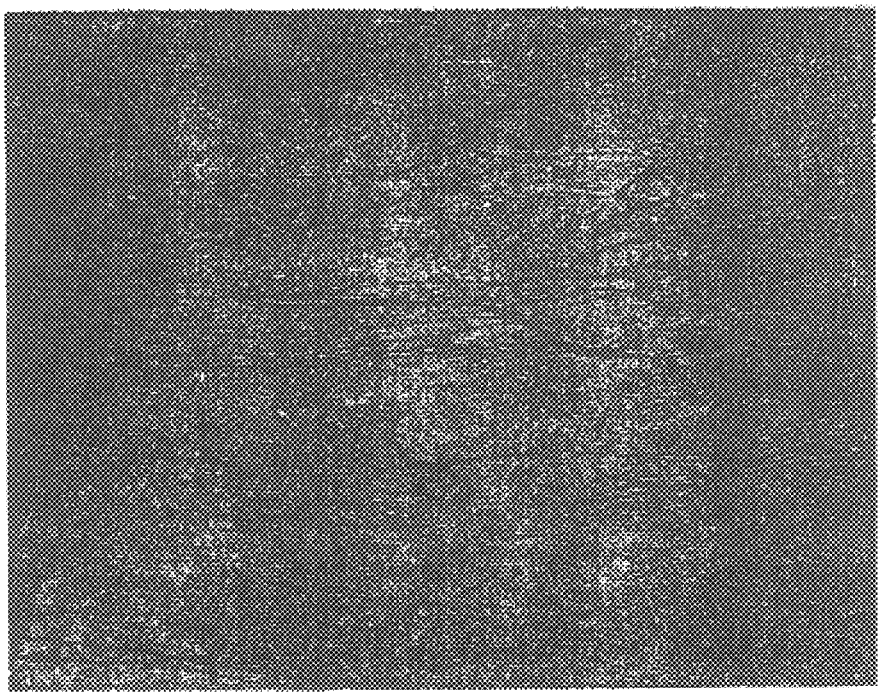
FIGS. 5(A), 5(B), and 5(C) are optical micrographs showing the microstructure of the comparative alloy (5) as hot-rolled, after heat-treatment at 1050° C. for 30 minutes, and after heat treatment at 1200° C. for 30 minutes, respectively.

FIG. 5(A) As hot-rolled, with work hardening

Figure 5B:
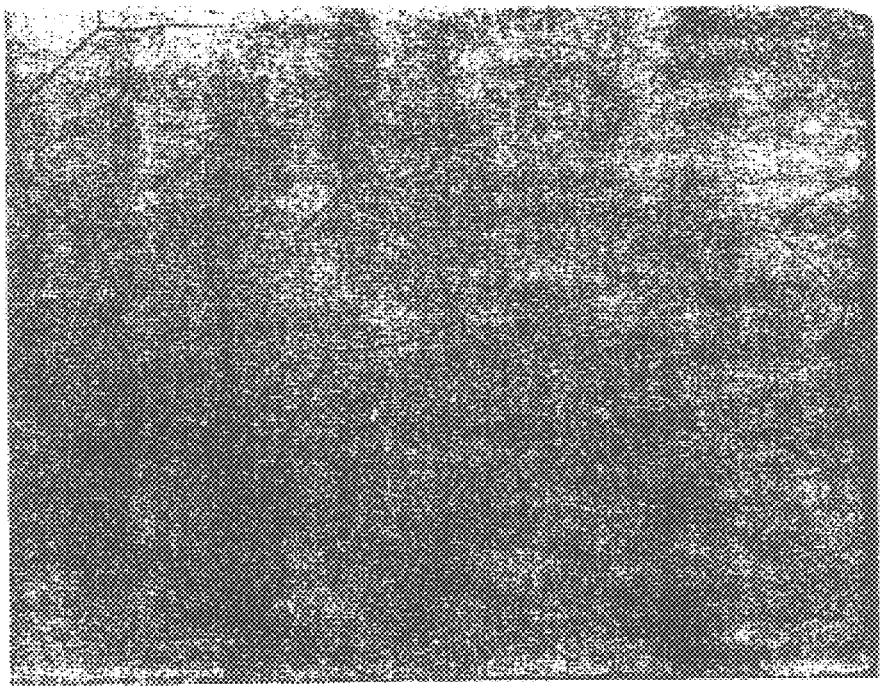

FIG. 5(B) Heat-treated at 1050° C. for 30 minutes, with recrystallization in the absence of precipitation of suicides to suppress recrystallization.

Figure 5C:
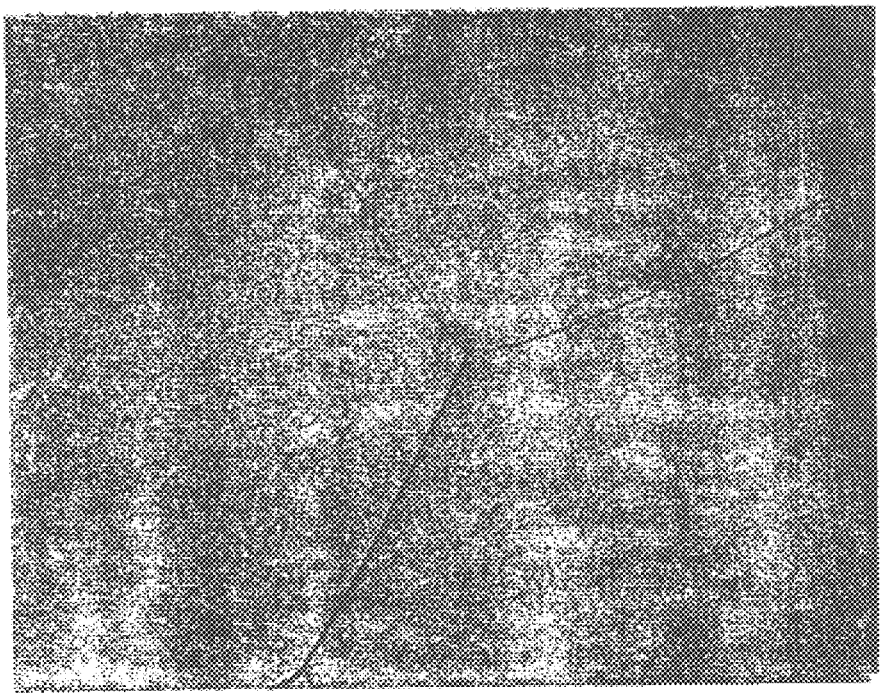

FIG. 5(C) Heat-treated at 1200° C. for 30 minutes, with coarse grains grown due to recrystallization.

Incidentally, the Ti-15Mo-5Zr-3Al alloy has a β transus at 785° C., which does not greatly change upon incorporation with Sn and Si in an amount specified above. The temperature of 1050° C. for the heat treatment that follows hot rolling is much higher than the β-transus.

TABLE 1

Effect of Si on precipitation or disappearance of the second phase and on suppression of recrystallization of the second phase

| | Alloy composition | Precipitation of the second phase at 1050° C. | Suppression of recrystallization by heating at 1050° C. | Disappearance of the second phase at 1200° C. |
|---|---|---|---|---|
| Example | (1) 15Mo-5Zr-3Al-0.5Si | Yes | Yes | Yes (recrystallized) |
| | (2) 15Mo-5Zr-3Al-3Sn-0.3Si | Yes | Yes | Yes (recrystallized) |
| Comparative | (3) 15Mo-5Zr-3Al | No | No (recrystallized) | — |
| Example | (4) 15Mo-5Zr-3Al-0.3Si | No | No (recrystallized) | — |
| | (5) 15Mo-5Zr-3Al-3Sn | No | No (recrystallized) | — |

Table 1 shows the effect of Si incorporated into the Ti-15Mo-5Zr-3Al alloy on whether or not the second phase precipitates at 1050° C. or disappears at 1050° C. and whether or not the second phase suppresses recrystallization.

It is noted that the Ti-15Mo-5Zr-3Al alloy (3) (as the base alloy) without Si and Sn suffered recrystallization due to reheating because it does not cause the second phase to precipitate in the form of fine dispersion which suppresses recrystallization. It is also noted that the alloy (4) (the base alloy plus 0.3% Si) does not cause the second phase to precipitate in the form of fine dispersion and hence does not produce the effect of suppressing recrystallization.

By contrast, it is noted that the alloy (1) (the base alloy plus 0.5% Si) causes the second phase to precipitate in the form of fine dispersion and hence suppresses recrystallization after reheating. However, upon heating at 1200° C. at which the second phase disappears, it loses the effect of suppressing recrystallization and hence suffers recrystallization.

The amount of Si to be incorporated varies depending on the kind and amount of other alloying elements, as mentioned above, and hence it cannot be established unequivocally. It is noted that the alloy with an adequate amount of Si causes the second phase to precipitate in the form of fine dispersion at a temperature above the β-transus, thereby suppressing recrystallization.

It is also noted that the alloy (5) (the base alloy plus 3% Sn) does not cause the second phase to precipitate but the alloy (2) (the base alloy plus 3% Sn and 0.3% Si) causes the second phase to precipitate and disappear. This suggests that incorporation with Si is essential for the alloy to cause the second phase to precipitate and disappear. Without Sn, the alloy causes the second phase to precipitate only when it is incorporated with 0.5% Si; however, with an adequate amount of Sn, the alloy produces the same effect when it is incorporated with 0.3% Si. It is desirable to incorporate the alloy with a small amount of Si along with an adequate amount of Sn, because an excess amount of Si precipitates, resulting in embrittlement due to precipitation hardening.

Of the five alloys shown in Table 1, the three alloys (2), (3), and (5) were tested for Vickers hardness immediately after hot rolling and after aging at 500° C. for 0.5 hours 8 hours. The results are shown in Table 2.

TABLE 2

Vickers hardness of hot-rolled sheet after aging

| | Alloy composition | Vickers hardness after aging at 500° C. (average of five measurements at 10 kgf) | | |
|---|---|---|---|---|
| | | As hot-rolled | After aging for 0.5 hours | After aging for 8 hours |
| Example | (2) 15Mo-5Zr-3Al-3Sn-0.3Si | 285.8 | 287.7 | 420.0 |
| Comparative | (3) 15Mo-5Zr-3Al | 267.0 | 376.0 | 442.7 |
| Example | (5) 15Mo-5Zr-3Al-3Sn | 264.8 | 301.0 | 450.0 |

It is apparent from Table 2 that the alloy (2) with both Sn and Si is slightly harder than the alloys (3) and (5) in as hot-rolled state. It appears that the increase in hardness of the alloy (2) is due to work hardening promoted by the precipitation of the second phase rather than the precipitation hardening by the second phase in view of the fact that the second phase precipitates at 1050° C. in such a small amount that the precipitate cannot be detected by an optical microscope as is noted from the photograph of structure in FIG. 2.

It is also noted from Table 2 that the alloys (3) and (5) suffer age hardening in a short time, with the latter suffering less due to incorporation with Sn, but the alloy (2) with both Sn and Si suffers substantially no age hardening in a short time (up to 0.5 hours), with the α phase sufficiently decreasing in the kinetics of precipitation. Nevertheless, the hardness of the alloy (2) approaches that of the alloy (3) after aging for a long time (8 hours), which suggests that the alloy retains the ability of precipitation hardening. If age hardening is delayed for about 0.5 hours, it would be possible to avoid age hardening due to remaining heat after the coiling of hot-rolled sheet. In other words, the alloy incorporated with both Sn and Si is exempt from age hardening due to remaining heat after coiling; therefore, it permits great improvement in productivity by coiling without posing the difficulties in recoiling due to hardening by remaining heat after coiling.

Figure 6:
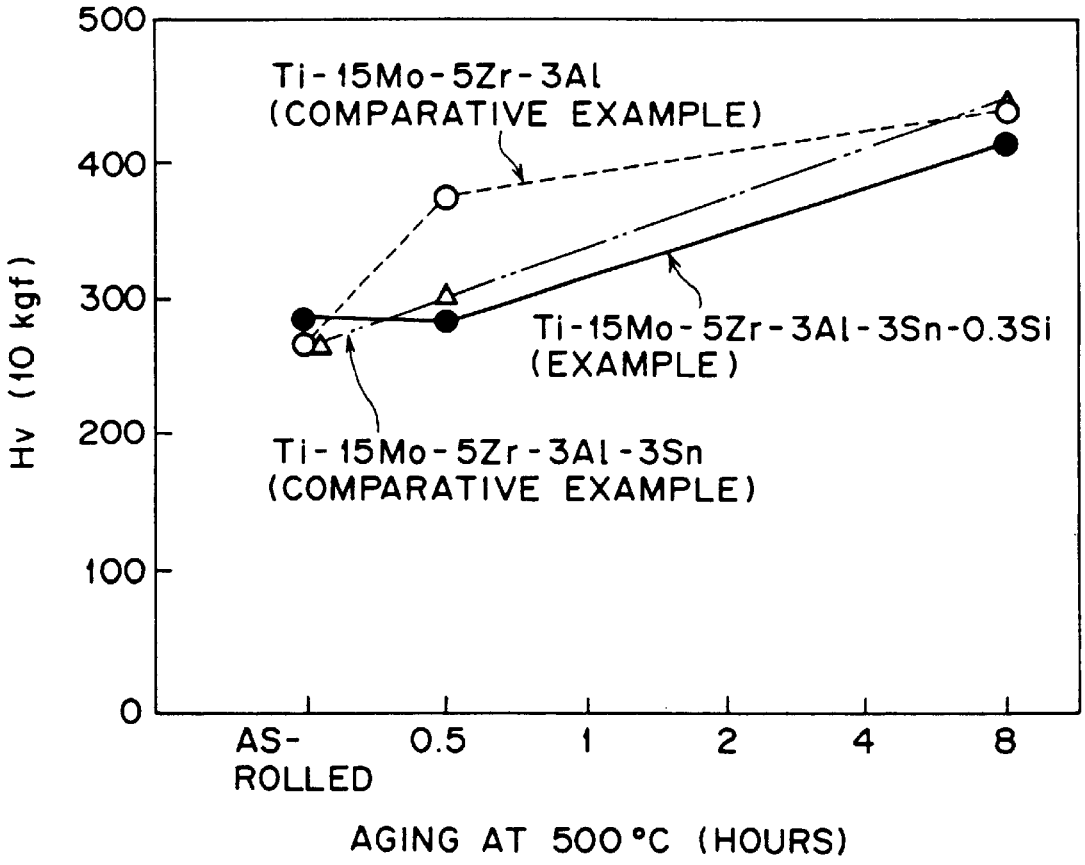
FIG. 6 is a graph showing the relation between the hardness of titanium alloys and aging time at 500° C.

The results in Table 2 are graphically represented in FIG. 6. It is noted that the base alloy (3) without Sn rapidly increases in hardness in the initial stage of aging and the alloy (5) with Sn alone also increases in hardness in the initial stage of aging, whereas the alloy (2) increases very little in hardness in the initial stage of aging (about 30 minutes corresponding to remaining heat after coiling) and hence causes no trouble with recoiling. After the initial stage, age hardening proceeds with time, so that the alloy eventually has sufficient strength.

The alloys (2), (3) and (5) were tested for tensile strength after aging at 500° C. for 8 hours. The results are shown in Table 3. The alloy (2) was made into a sheet by plastic deformation after heating at 1200° C. (at which the second phase disappears); therefore, it retained its unrecrystallized state due to the presence of the second phase even when it was kept at 1050° C. and hence it was aged without being heated above the temperature at which the second phase disappears.

TABLE 3

Tensile properties after aging

| | Alloy composition | Tensile properties after aging at 500° C. for 8 hours | | |
|---|---|---|---|---|
| | | Yield strength (MPa) | Tensile strength (MPa) | Elongation (%) |
| Example | (2) 15Mo-5Zr-3Al-3Sn-0.3Si | 1344 | 1437 | 2.4 |
| Comparative | (3) 15Mo-5Zr-3Al | 1372 | 1484 | 0.8 |
| Example | (5) 15Mo-5Zr-3Al-3Sn | 1436 | 1498 | 0.4 |

It is noted from Table 3 that as compared with the alloys (3) and (5), the alloy (2) is slightly lower in tensile strength but much higher in elongation. Such a small difference in tensile strength can be readily eliminated if the aging temperature is slightly lowered or the aging time is slightly extended. Thus the slightly low strength is not of practical problem. By contrast, the alloy (2) has 3–6 times as high elongation as the alloys (3) and (5) at a sacrifice of only tens of MPa in tensile strength. Improving elongation so much has been impossible with the conventional technology except for the unrealistic thermo-mechanical heat treatment.

A probable reason for such unusual results in the present invention is that the precipitation of the second phase that takes place during plastic deformation promotes work hardening and a large number of sites for precipitation of the α phase occur in the matrix, so that the α phase precipitates in the form of uniform fine grains after aging.

EXAMPLE 2

A series of near-β titanium alloys Ti-5Al-2Sn-2Zr-4Mo-4Cr (Ti-17) with Si in a varying amount from 0 to 1.2% were prepared. They were cast into ingots. Each ingot weighing about 10 kg was forged at 1200° C. to make a billet measuring 60 mm wide, 45 mm thick, and 800 mm long. The temperature at the end of forging was about 800° C. The thus obtained billet was cut in lengths of about 200 mm.

The cut billet was heated to 1200° C. and then hot-rolled so as to reduce the thickness from 45 mm to 22 mm. This hot rolling was carried out in various ways such that it finishes at 850° C. to 1000° C. Some billets were cut during hot rolling and heated again to 950° C. and rolled again to reduce the thickness from 22 mm to 18 mm, followed by air cooling.

The thus rolled materials underwent solution treatment (at 800° C. for 4 hours, followed by water quenching) and aging (at 620° C. for 8 hours, followed by air cooling). They were tested for ductility (elongation and reduction of area) and fracture toughness. They were also examined for morphology of microstructure. Some samples underwent pretreatment (heating at a prescribed temperature for 2 hours, followed by air cooling) prior to said solution treatment and aging. Some other samples underwent aging alone (without solution treatment).

The treated samples were tested for tensile strength, elongation, and fracture toughness. The results are shown in Table 4. The Si-free alloy is regarded as reference. Incidentally, the β-transus of the alloys tested was about 890° C. The temperature at which silicides precipitate was about 950° C., and the solvus at which silicides disappear was about 1000° C.

TABLE 4

Structure and properties of samples after age treatment

| | No. | Amount of Si added (mass %) | Temperature at end of working | Temperature at end of rolling after reheating | Heating before heat treatment | Solution treatment | Structure after aging treatment | Elongation (%) | Fracture toughness (kgf/mm$^2$) |
|---|---|---|---|---|---|---|---|---|---|
| Example | 1 | 0.2 | 950° C. | No reheating | No heating | Yes | Acicular allover | 8 | 185 |
| | 2 | 0.5 | 950° C. | No reheating | No heating | Yes | Acicular allover | −7 | 190 |
| | 3 | 0.8 | 950° C. | No reheating | No heating | Yes | Acicular allover | 6 | 160 |
| | 4 | 0.5 | (950° C.) | 900° C. | No heating | Yes | Acicular allover | 6 | 195 |
| | 5 | 0.5 | (950° C.) | 850° C. | 950° C. | Yes | Acicular allover | 6 | 190 |
| | 6 | 0.5 | 950° C. | No reheating | No heating | No | Acicular allover | 6 | 200 |
| | 7 | 0.5 | (950° C.) | 850° C. | 950° C. | No | Acicular allover | 6 | 205 |
| Reference | 8 | None | 900° C. | No reheating | No heating | Yes | Acicular allover | 6 | 160 |
| | 9 | None | 950° C. | No reheating | No heating | Yes | Grain boundary α phase | 4 | 190 |
| | 10 | None | (900° C.) | 900° C. | No heating | Yes | Grain boundary α phase | 3 | 195 |
| | 11 | None | 850° C. | No reheating | 900° C. | Yes | Grain boundary α phase | 2 | 190 |
| | 12 | None | 850° C. | No reheating | No heating | Yes | Grain boundary α phase | 8 | 135 |
| | 13 | None | 850° C. | No reheating | 900° C. | Yes | Grain boundary α phase | 2 | 180 |
| Comparative | 14 | 0.1 | 950° C. | No reheating | No heating | Yes | Grain boundary α phase | 3 | 190 |
| Example | 15 | 0.1 | 850° C. | No reheating | 900° C. | Yes | Grain boundary α phase | 4 | 165 |
| | 16 | 1.2 | 950° C. | No reheating | No heating | Yes | Acicular allover | 0 | 200 |
| | 17 | 1.2 | 950° C. | No reheating | 950° C. | Yes | Acicular allover | 0 | 210 |
| | 18 | 0.5 | 1000° C. | No reheating | No heating | Yes | Grain boundary α phase | 1 | 195 |
| | 19 | 0.5 | 950° C. | No reheating | 1050° C. | Yes | Grain boundary α phase | 0 | 180 |

* Parenthesized temperatures remind the importance of the temperature at the end of rolling after reheating.

It is noted from Table 4 that the alloy (No. 9) without Si suffered remarkable precipitation of grain boundary α phase and hence was poor in ductility when working finished at 950° C. By contrast, it is noted that the alloys Nos. 1, 2, and 3) with more than 0.3% Si did not reduce in ductility even though working finished below 1000° C. The alloys Nos. 4 and 5, whose working finished below 1000° C., did not decrease in ductility even though they were reheated to a temperature under 1000° C., regardless of whether they were reheated before working or heated before heat treatment. By contrast, the alloys (Nos. 10, 11, and 13) without Si apparently decreased in ductility.

The alloy (No. 13) without Si, whose working finished at 850° C. which is lower than the β-transus, decreased in ductility when heated before heat treatment. On the other hand, the alloy (No. 12) without Si, which was not heated, decreased in toughness because the equiaxial α phase formed. By contrast, the alloy (No. 7) with an adequate amount of Si had good properties on reheating at a temperature above the β-transus and below 1000° C. even though its working finished at a temperature below the β transus. However, the alloy (No. 18) decreased in ductility when its working finished above 1000° C. and the alloy (No. 19) also decreased in ductility when it was reheated above 1000° C., even though they contain an adequate amount of Si, because the grain boundary α phase formed considerably.

The alloys (Nos. 14 and 15) with 0.1% Si were as poor in ductility as the alloys without Si. The alloys (Nos. 16 and 17) with more than 1.0% Si were comparable in structure to those with an adequate amount of Si but were poor in ductility due to precipitation hardening by suicides.

Incidentally, the titanium alloys of this kind usually undergo solution treatment in the two-phase region to homogenize the β matrix prior to the final aging treatment. However, the titanium alloys such as those (Nos. 6 and 7) in the present invention which contain an adequate amount of Si do not need solution treatment in the two-phase region because they give a uniform β matrix as hot-rolled (because reheating and working are possible and the rising temperature can be set easily above the β-transus) or after heating above the β-transus (below 1000° C.).

EXAMPLE 3

The alloys in Example 2 meet the requirements prescribed in claim 4. Therefore, they have a macrostructure of about 0.5 mm which is much smaller than that of ingot (coarse β grains of about 20 mm). This was confirmed by microscopic observation.

For investigation into the factor which makes the macrostructure fine, the following experiment was carried out. A 45-mm thick stock for rolling was cut directly out of an ingot. It was heated to 1200° C. and rolled (50%) such that rolling finished at varied temperatures from 1100 to 850° C. at intervals of 50° C. The rolled product was heated at varied temperatures from 1100 to 850° C. at intervals of 50° C. for 2 hours. The thus obtained sample was examined for macrostructure.

It was found that those samples whose working finished at a temperature above 1000° C. did not have their macrostructure refined (although flattened) as the result of reheating at any temperature for 2 hours, whereas those samples whose working finished at a temperature below 950° C. had their macrostructure greatly refined. However, even after heating at a temperature below 950° C., they remained to have the coarse macrostructure as in the case of the sample whose working finished above 1000° C.

EXAMPLE 4

To see the effect on structure produced by incorporating Si into titanium alloys (which is the fundamentals of the present invention), two kinds of titanium alloys were prepared, one having a conventional composition of Ti-5Al-2Sn-2Zr-4Mo-4Cr and the other having an improved composition of Ti-5Al-2Sn-2Zr-4Mo-4Cr-0.5Si. Incidentally, the second titanium alloy contains silicides which precipitate at about 950° C. and dissolve at about 1000° C.

Each of the titanium alloys was made into an ingot (weighing 120 g and measuring about 20 mm wide) by button melting. The ingot was heated to 1200° C. and hot-rolled to a thickness of 5 mm without reheating. Working finished at 700° C. This hot working is the typical β process.

The resulting rolled stock underwent the standard heat treatment (solution treatment and aging treatment) at 800° C. for 4 hours (followed by water quenching) plus at 620° C. for 8 hours (followed by air cooling). The treated samples were examined to see if the β process gives the overall acicular structure in the Si-containing alloy.

Figure 7A:
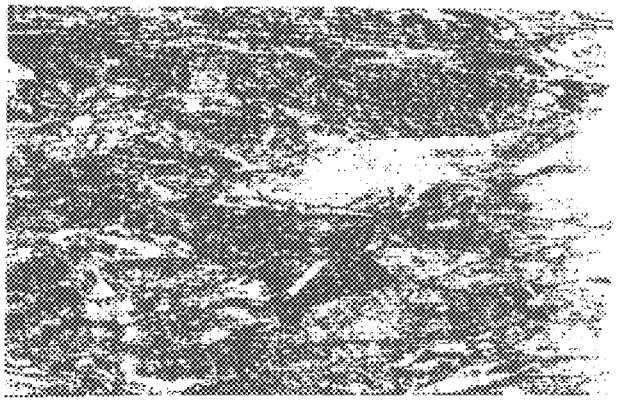
FIG. 7 is an optical micrograph of the Ti-5Al-2Sn-2Zr-4Mn-4Cr alloy without Si (as the reference) which has undergone the conventional β process.
Figure 7B:
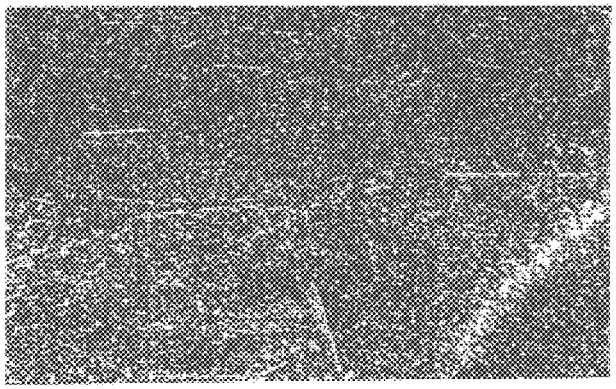
Figure 7C:
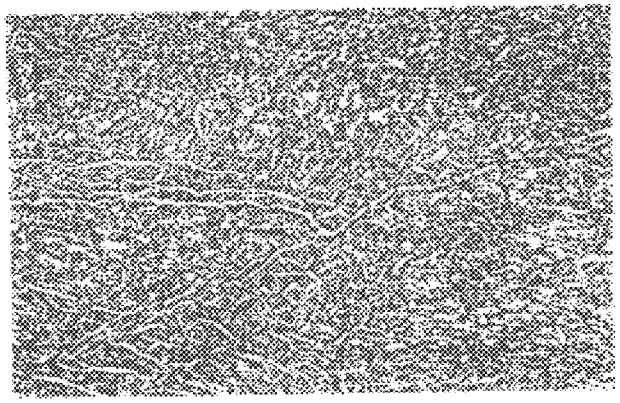

The results are shown in FIG. 7, photographs showing the structure of the Ti-5Al-2Sn-2Zr-4Mn-4Cr alloy without Si after the β process. Magnifications of 20, 100, and 400 in FIGS. 7(A), 7(B), and 7(C), respectively. It is noted that the acicular α phase is dispersed throughout the unrecrystallized β matrix.

Figure 8A:
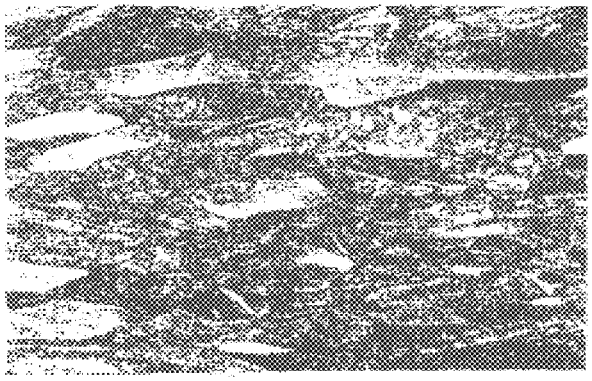
FIG. 8 is an optical micrograph of the Ti-5Al-2Sn-2Zr-4Mn—4Cr-0.5Si alloy which has undergone the β process.
Figure 8B:
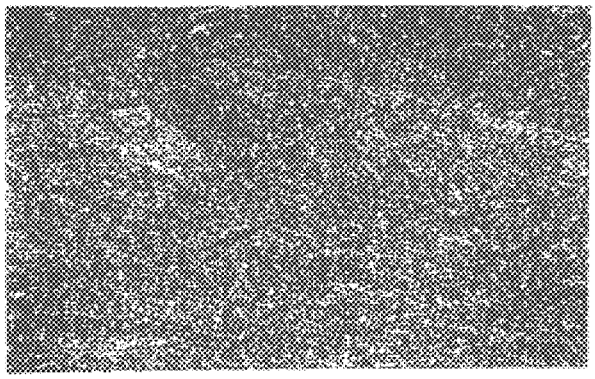
Figure 8C:
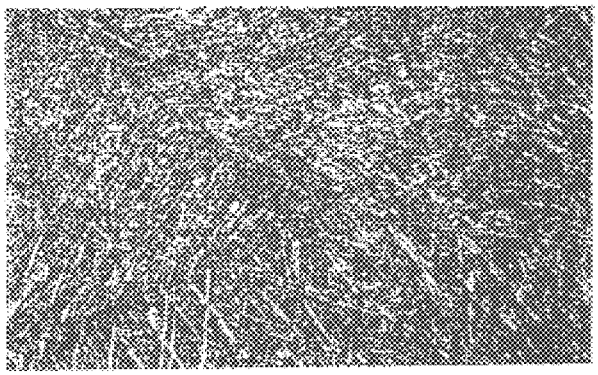

The results are also shown in FIG. 8, photographs showing the structure of the Ti-5Al-2Sn-2Zr-4Mn-4Cr-0.5Si alloy (with 0.5% Si) after the β process. Magnifications of 20, 100, and 400 in FIGS. 8(A), 8(B), and 8(C), respectively. It is noted that the acicular α phase is dispersed throughout the unrecrystallized β matrix as in the case of the alloy without Si. This suggests that Si does not prevent the acicular α phase from forming all over.

In both cases, the β matrix is in the unrecrystallized state, with the acicular structure spreading all over such that the precipitation of the grain boundary α phase is suppressed and a large number of α needles precipitate in the grains. In other words, incorporation with Si does not prevent the microstructure from becoming acicular by the ordinary β process.

For investigation into the possibility that the formation of the acicular structure mentioned above is adversely affected by the reheating during hot working or by the heating above the β-transus after hot working, the alloys were heated at 950° C. for 2 hours and then underwent solution treatment and aging treatment (at 800° C. for 4 ours, followed by water quenching, plus at 620° C. for 8 hours, followed by air cooling) in the same manner as mentioned above, and they were examined for microstructure.

Figure 9A:
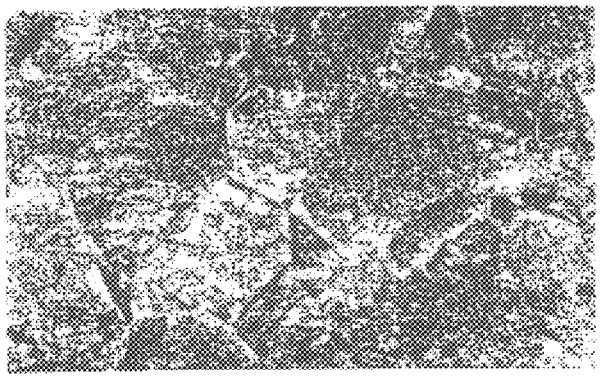
FIG. 9 is an optical micrograph of the Ti-5Al-2Sn-2Zr-4Mn-4Cr alloy without Si (as the reference) which has undergone hot working, heating at 950° C., solution treatment, and aging treatment.
Figure 9B:
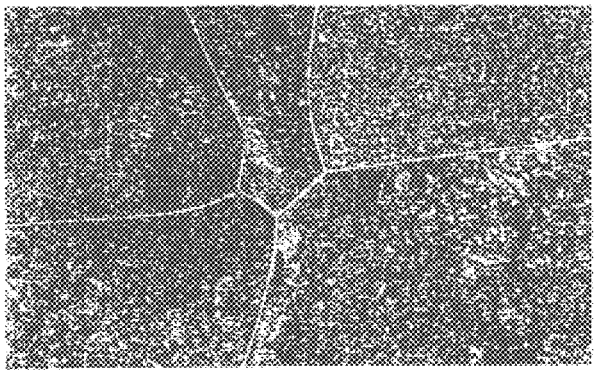
Figure 9C:
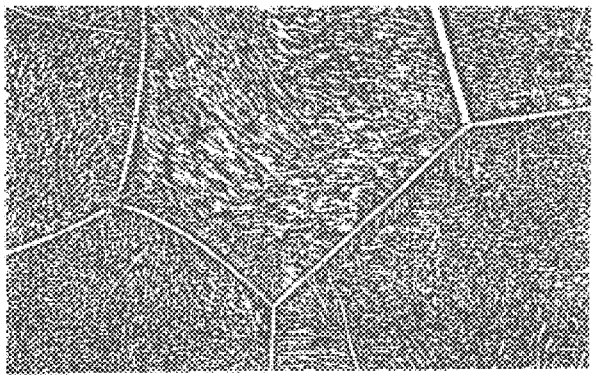

The results are shown in FIG. 9, photographs showing the microstructure of the Ti-5Al-2Sn-2Zr-4Mn-4Cr alloy without Si after heat treatment. Magnifications of 20, 100, and 400 in FIGS. 9(A), 9(B), and 9(C), respectively. It is noted that the β matrix recrystallizes, manifesting itself as the equiaxial grains, with the α phase precipitating in film form on the grain boundary, which causes a decrease in ductility.

Figure 10A:
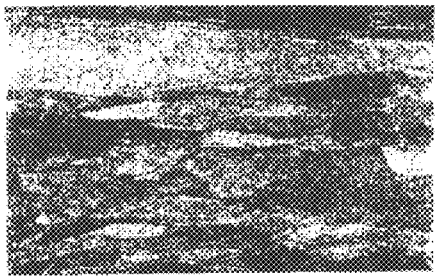
FIG. 10 is an optical micrograph of the Ti-5Al-2Sn-2Zr-4Mn—4Cr-0.5Si alloy which has undergone hot working, heating at 950° C., solution treatment, and aging treatment.
Figure 10B:
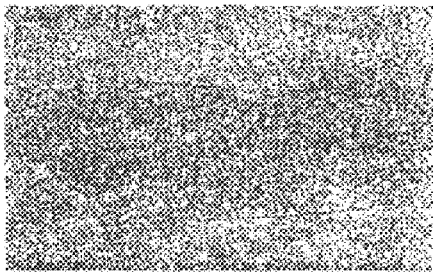
Figure 10C:
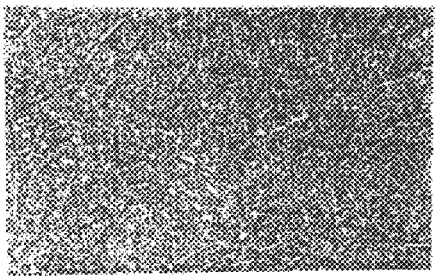

The results are also shown in FIG. 10, photographs showing the microstructure of the Ti-5Al-2Sn-2Zr-4Mn-4Cr-0.5Si alloy (with 0.5% Si) after heat treatment. Magnifications of 20, 100, and 400 in FIGS. 10(A), 10(B), and 10(C), respectively. It is noted that the acicular α phase is dispersed throughout the unrecrystallized β matrix as in the case of FIGS. 7 and 9.

In the case of the alloy without Si (as shown in FIG. 9), β grains recrystallized due to heating at 950° C. and hence the grain boundary α phase (which causes a decrease in ductility) remarkably precipitated. This is the reason why the precipitation of the grain boundary α phase cannot be prevented by the conventional β process. By contrast, in the case of the alloy with 0.5% Si (as shown in FIG. 10), the overall acicular structure was obtained (as in the case shown in FIG. 8) despite reheating at 950° C.

Figure 11:
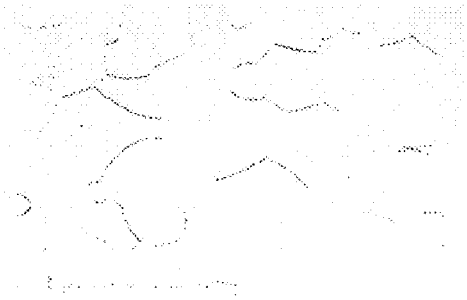
FIG. 11 is an optical micrograph of the Ti-5Al-2Sn-2Zr-4Mn—4Cr-0.5Si alloy which has undergone hot working, heating at 1000° C. for solution of suicides, and water quenching without solution treatment and aging treatment.

FIG. 11 shows the microstructure of the Ti-5Al-2Sn-2Zr-4Mn—4Cr-0.5Si alloy (with 0.5% Si) which was heated at 1000° C. for 30 minutes and then water-quenched. The alloy does not have the α phase precipitation because it did not undergo solution treatment and aging treatment. Hence, FIG. 11 differs from FIG. 9. Nevertheless, it is noted that the β grains are recrystallized equiaxial grains and the effect of suppressing recrystallization is not produced at temperatures above 1000° C. at which silicides disappear.

EXAMPLE 5

Titanium alloys of the composition shown in Table 5 were made into ingots by button melting. Each ingot was heated to 1200° C. and hot-rolled (with 50% reduction). The rolled piece was kept at 1050° C. for 10 minutes and then hot-rolled again (with 75% total reduction).

The alloys were examined for hot-rollability according to whether or not they suffered edge cracking during hot tolling. The result of the base alloy (Ti-15Mo-5Zr-3Al β alloy) was regarded as reference. The samples were rated as good or poor by comparison with the reference.

One-third of the hot-rolled strips had their edges trimmed and then cold-rolled (with 10% reduction) without annealing. The alloys were examined for cold-rollability according to whether or not they suffered edge cracking during cold rolling. The samples were rated as good (without edge cracking) and poor (with edge cracking).

One-third of the hot-rolled strips underwent aging treatment at 500° C. for 30 minutes to evaluate the aging rate delaying effect. The samples were tested for Vickers hardness. The Vickers hardness of the as-hot-rolled sample was regarded as reference. The samples were rated as good (with very little increase in Vickers hardness and capable of coiling) and as poor (with remarkable increase in Vickers hardness and incapable of coiling) by comparison with the reference.

The remaining one-third of the hot-rolled strips underwent aging treatment at 500° C. for 8 hours. Then they were tested for tensile properties. The results were compared with those of sheet (rolled from a cut sheet) of commercial Ti-15Mo-5Zr-3Al alloy. The samples were rated as good if they have as good strength-elongation balance as the commercial sheet; otherwise, they were rated as poor.

The results are shown in Table 5. It is noted that the titanium alloys (Nos. 1 to 5) meeting the requirements prescribed in the present invention are good in hot- and cold-rollability, aging rate delay effect, and strength-elongation balance after aging treatment. They have high strength and good workability (productivity) suitable for use as the golf club face. By contrast, the titanium alloys (Nos. 7 to 10) for comparison, which do not meet the requirements prescribed in the present invention, are poor in at least one of hot- and cold-rollability, aging rate delay effect (recoilability), and strength-elongation balance after aging treatment. Therefore, they do not achieve the object of the present invention.

The alloys (Nos. 11 to 16) for comparison contain Sn and Si in adequate amounts but contain any of Mo, Zr, and Al in an amount outside the preferred range. Therefore, they are poor in at least one of hot- and cold-rollability, aging rate delay effect (recoilability), and strength-elongation balance after aging treatment. This suggests that the present invention produces its full effect when applied to the base alloy of Ti-15Mo-5Zr-3Al.

TABLE 5

| Sample No. | Alloy composition | Hot-rollability | Cold--rollability | Aging rate delay effect | Strength-elongation balance after aging |
|---|---|---|---|---|---|
| 1 | 15Mo-5Zr-3Al-3Sn-0.05Si | Good | Good | Good, coilable | Good |
| 2 | 15Mo-5Zr-3Al-0.7Sn-0.3Si | Good | Good | Good, coilable | Good |
| 3 | 15Mo-5Zr-3Al-3Sn-0.3Si | Good | Good | Good, coilable | Good |
| 4 | 15Mo-5Zr-3Al-4Sn-0.8Si | Good | Good | Good, coilable | Good |
| 5 | 15Mo-5Zr-3Al-6Sn-0.3Si | Good | Good | Good, coilable | Good |
| 6 | 15Mo-5Zr-3Al | Reference (good) | Reference (good) | Reference, not coilable | Reference (good) |
| 7 | 15Mo-5Zr-3Al-0.3Sn-0.3Si | Good | Good | Poor, not coilable | Good |
| 8 | 15Mo-5Zr-3Al-7Sn-0.3Si | Good | Poor | Good, coilable | Poor |
| 9 | 15Mo-5Zr-3Al-3Sn-0.02Si | Good | Good | Poor, not coilable | Good |
| 10 | 15Mo-5Zr-3Al-3Sn-1.2Si | Good | Poor | Good, coilable | Poor |
| 11 | 12Mo-5Zr-3Al-3Sn-0.3Si | Poor | Poor | Poor, not coilable | Poor |
| 12 | 18Mo-5Zr-3A1-3Sn-0.3Si | Good | Good | Good, coilable | Poor |
| 13 | 15Mo-2Zr-3Al-3Sn-0.3Si | Good | Good | Good, coilable | Poor |
| 14 | 15Mo-8Zr-3Al-3Sn-0.3Si | Poor | Poor | Good, coilable | Poor |
| 15 | 15Mo-5Zr-1.0Al-3Sn-0.3Si | Good | Good | Good, coilable | Poor |
| 16 | 15Mo-5Zr-5.0Al-3Sn-0.3Si | Good | Poor | Good, coilable | Poor |

The present invention provides a new titanium alloy which is formed by incorporating a β alloy or near-β alloy with Si in an adequate amount. Upon heating, the alloy permits silicides to dissolve and precipitate in fine grain form, thereby preventing recrystallization. Because of these properties, the alloy is capable of repeated annealing and working. When incorporated with Sn in addition to Si, the alloy produces the aging delay effect. This effect suppresses hardening due to remaining heat after coiling and hence enables recoiling. The resulting alloy has sufficient strength.

What is claimed is:

1. A process for producing a titanium alloy, the process comprising heating a β, or near-β, titanium alloy containing not more than 1.0 mass %, excluding 0 mass %, of Si to the solvus of suicides or above to form a β phase with the Si in solid solution;

plastically deforming the P phase at a temperature above the β-transus; and precipitating suicides in the β phase in a form of particles, wherein the particles of silicides suppress recrystallization of the plastically deformed β phase.

2. The process according to claim 1, further comprising heating the plastically deformed β phase including the precipitated silicides to a temperature above the β-transus and below the solvus of silicides without recrystallizing the plastically deformed βphase.

3. The process according to claim 1, wherein the solvus of silicides is a temperature of 120° C.

4. The process according to claim 1, wherein the silicides are precipitated during the plastic deformation of the β phase.

5. The process according to claim 1, wherein the silicides are precipitated at a temperature in a range of from 1050° C. to 1200° C.

6. A process for producing a titanium alloy containing an acicular a phase and a β phase, the process comprising hot working a β, or near-β, titanium alloy containing not more than 1.0 mass %, excluding 0 mass %, of Si such that the hot working finishes at a temperature above the β-transus and below the solvus of silicides;

maintaining the hot-worked alloy in a temperature range between the a-transus and the β-transus; and precipitating the acicular a phase within a matrix of the β phase, wherein the maintaining comprises at least one of a solution treatment and an aging treatment.

7. The process according to claim 6, wherein the solvus of suicides is a temperature of 1200° C.

8. The process according to claim 6, wherein the β, or near-β, titanium alloy is a titanium ingot; and the process further comprises, between the hot working and the maintaining, heating the hot-worked alloy to a temperature above a precipitation temperature of silicides and below the solvus of silicides.

9. The process according to claim 8, wherein the precipitation temperature of silicides is 1050° C. and the solvus of silicides is a temperature of 1200° C.

* * * * *